US011820159B2

(12) United States Patent
Tobimatsu et al.

(10) Patent No.: US 11,820,159 B2
(45) Date of Patent: Nov. 21, 2023

(54) NAIL PRINTING APPARATUS AND CONTROL METHOD

(71) Applicant: CANON KABUSHIKI KAISHA, Tokyo (JP)

(72) Inventors: Daisuke Tobimatsu, Kanagawa (JP); Kenichi Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/700,725

(22) Filed: Mar. 22, 2022

(65) Prior Publication Data

US 2022/0305824 A1 Sep. 29, 2022

(30) Foreign Application Priority Data

Mar. 26, 2021 (JP) ..... 2021-053239

(51) Int. Cl.

| | |
|---|---|
| ***B41J 3/407*** | (2006.01) |
| ***B41J 25/00*** | (2006.01) |
| ***B41J 29/38*** | (2006.01) |
| ***B41J 2/165*** | (2006.01) |

(52) U.S. Cl.

CPC ..... *B41J 25/006* (2013.01); *B41J 3/407* (2013.01); *B41J 29/38* (2013.01); *B41J 2/165* (2013.01)

(58) Field of Classification Search

CPC . B41J 25/006; B41J 3/407; B41J 29/38; B41J 2/165

See application file for complete search history.

(56) References Cited

U.S. PATENT DOCUMENTS

2011/0058207 A1* 3/2011 Morishita ..... B41J 13/0009 358/1.14
2014/0060560 A1* 3/2014 Bitoh ..... A45D 29/00 132/73
2017/0015112 A1* 1/2017 Yoshigai ..... B41J 11/008

FOREIGN PATENT DOCUMENTS

JP 2008201082 A * 9/2008 ..... B41J 19/202
JP 2017-023202 A 2/2017

* cited by examiner

*Primary Examiner* — Yaovi M Ameh
(74) *Attorney, Agent, or Firm* — Venable LLP

(57) ABSTRACT

A nail printing apparatus includes a print head to perform a printing operation in which an image on a nail of a person to be printed is printed by moving in a scanning direction and ejecting ink from a nozzle, and a control unit to control movement of the print head. In a case where movement of the print head is stopped regardless of controlling of movement of the print head associated with the printing operation, the control unit switches the controlling of movement of the print head after the stopping based on a stop position of the print head.

20 Claims, 10 Drawing Sheets

| FIG.5A | |
|---|---|
| | FIG.5B |

SCREEN IN A CASE WHERE THE DESIGNS ARE SET

SCREEN IN A CASE WHERE THE DESIGNS HAVE NOT BEEN SET

NAIL PRINTING APPARATUS AND CONTROL METHOD

BACKGROUND OF THE DISCLOSURE

Field of the Disclosure

The present disclosure relates to a nail printing apparatus and a control method.

Description of the Related Art

There is a method for printing nail art on a nail of a person to be printed by use of a printer. Hereinafter, the printer that prints nail art on a nail will be referred to as a nail printing apparatus.

In Japanese Patent Laid-Open No. 2017-23202, the method of stopping the driving of a printhead in a case of detecting a change in the position of a detector supported by the printhead.

If the driving of the print head with which a printing operation is in progress is stopped by the method of Japanese Patent Laid-Open No. 2017-23202, ink will not be ejected from the nozzles of the print head, and thus there is a case in which the ink adhering to the nozzles dries. Therefore, there is a possibility that a trouble occurs at a timing when the printing operation is restarted.

SUMMARY OF THE DISCLOSURE

The nail printing apparatus of the present disclosure comprises: a print head configured to perform a printing operation in which an image on a nail of a person to be printed is printed by moving in a scanning direction and ejecting ink from a nozzle; and a control unit configured to control movement of the print head, wherein, in a case where movement of the print head is stopped regardless of controlling of movement of the print head associated with the printing operation, the control unit switches the controlling of movement of the print head after the stopping based on a stop position of the print head.

Further features of the present disclosure will become apparent from the following description of exemplary embodiments with reference to the attached drawings.

DESCRIPTION OF THE EMBODIMENTS

Hereinafter, the forms of the technique in the present disclosure will be explained in detail. Note that the following embodiments are examples for explaining the technique of the present disclosure and are not intended to limit the technique of the present disclosure to those embodiments only. Further, the technique of the present disclosure can be modified in various ways to an extent that does not deviate from the gist thereof. Note that the same configurations will be explained with the same reference signs. Further, the relative positions, shapes, etc., of the constituent elements described in the following embodiments are merely examples.

First Embodiment

In the present embodiment, a nail printing apparatus that prints a nail design on a nail of a person to be printed will be explained. There is a case in which the nail printing apparatus executes an emergency stop, in which the driving of the print head is stopped while the operation for printing a nail design is in progress. In the present embodiment, a method of controlling the movement of the print head after the print head is emergently stopped will be explained.

System Configuration

Figure 1:
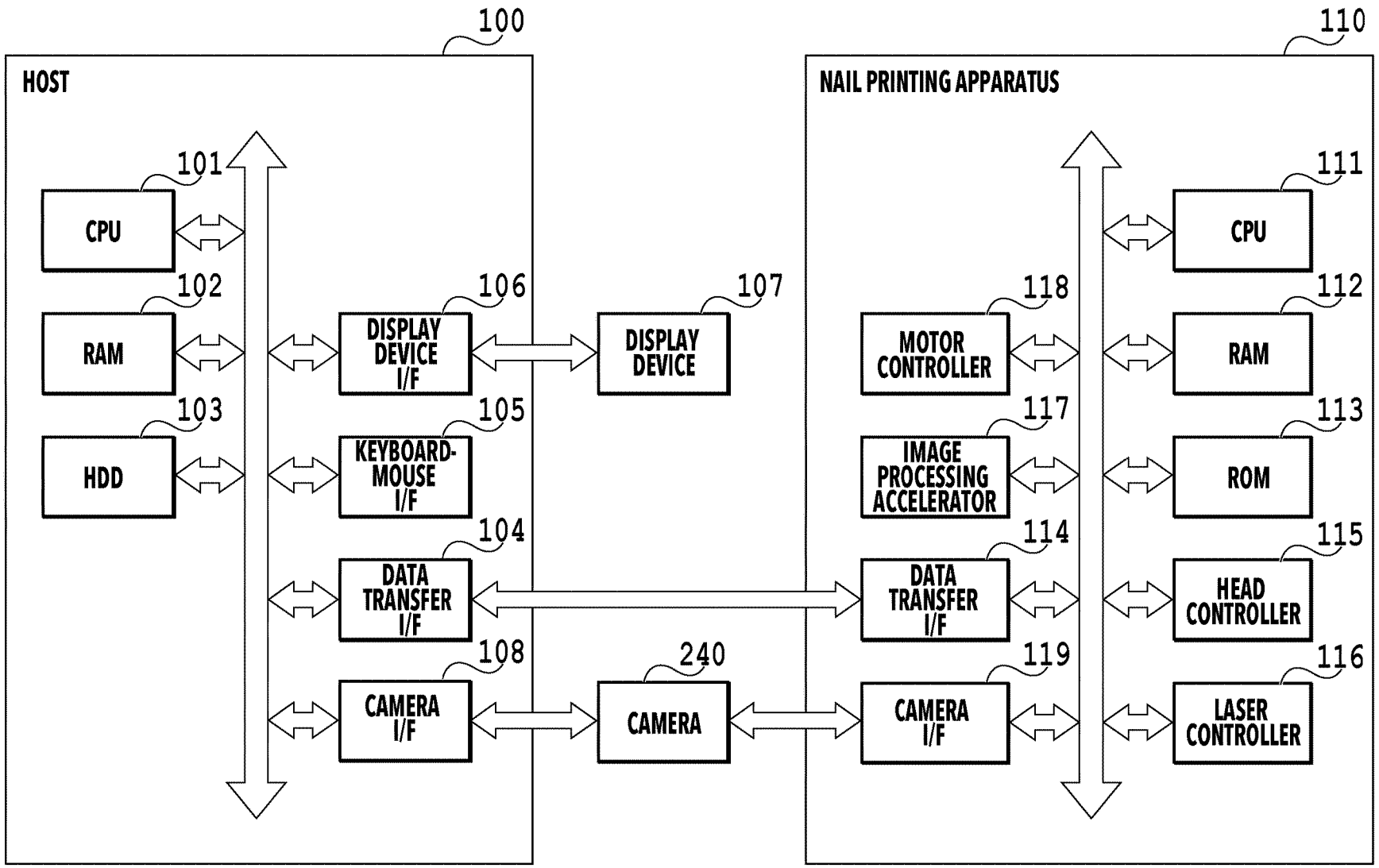
FIG. 1 is a block diagram illustrating a configuration of a printing system.

FIG. 1 is a block diagram illustrating the configuration of the printing system of the present embodiment. The printing system includes the host 100 and the nail printing apparatus 110. The nail printing apparatus 110 is an apparatus having a function of drawing an image directly on a nail of a hand of a person to be printed. Note that, although the present embodiment shows the example in which a nail of a hand is a printing target, the printing target is not limited to a hand and may be a toenail.

The host 100 is an information processing apparatus such as a personal computer (PC), for example. The host 100 may be a mobile terminal such as a smartphone. The host 100 is configured to be capable of communicating with the nail printing apparatus 110. The host 100 and the nail printing apparatus 110 are connected via a predetermined network or are directly connected without a network, so that information can be exchanged with each other. Note that, although the host 100 and the nail printing apparatus 110 will be explained as separate apparatuses in the present embodiment, such a form of using an apparatus which integrally includes the functions of both is also possible.

The host 100 has the CPU 101, the RAM 102, the HDD 103, the data transfer I/F 104, the keyboard-mouse I/F 105, the display device I/F 106, and the camera I/F 108.

The CPU 101 executes the later-described processing according to a program that is held in the HDD 103 or the RAM 102. The program includes an application program for printing a design image such as nail art on a nail with the nail printing apparatus 110. For example, an application program that sends a print job for printing an image to be printed to the nail printing apparatus 110 in response to an operation from the user is included. The application having such a function is hereinafter referred to as a nail app or simply an app. Note that the apps may have another function other than the printing function. For example, the apps in the present embodiment may have a function of activating the camera 240. That is, other than a print job, the apps may have a function of sending a camera activation job, etc. Further, the applications that are held in the HDD 103 or the RAM 102 are not limited to nail apps and may be application programs having a function other than printing. Hereinafter, a design image such as nail art is also referred to as a nail image.

The RAM 102 is a volatile storage, which temporarily holds programs and data. The HDD 103 is a non-volatile storage, which holds programs and data.

The data transfer I/F (interface) 104 controls transmission and reception of data to and from the nail printing apparatus 110. As the connection method for this transmission and reception of data, a wired connection such as USB, IEEE1394, and LAN and a wireless connection such as Bluetooth (registered trademark) and Wi-Fi (registered trademark) can be used. The data transmitted to and received from the nail printing apparatus 110 includes various kinds of control data. Further, the data transmitted to and received from the nail printing apparatus 110 includes image data of an image to be printed, which is output from the host 100 to the nail printing apparatus 110.

The keyboard-mouse I/F (interface) 105 is an I/F that controls an HID (Human Interface Device), such as a keyboard and mouse which are not illustrated in the drawings. The user can input various kinds of information via this I/F. The CPU 101 is configured to be capable of accepting instructions from the user through the keyboard-mouse I/F 105.

The display device I/F (display device interface) 106 controls displaying on the display device 107. The display device 107 is a display device of a liquid crystal, an organic EL, etc., for example. It is also possible that the display device 107 is included in the configuration of the host 100. The CPU 101 is capable of controlling displaying on the display device 107 via the display device I/F 106. Further, it is also possible that the display device 107 serves as an input unit in a form of a touch panel display device. The camera I/F 108 is an I/F for connecting to the camera 240.

The nail printing apparatus 110 includes the CPU 111, the RAM 112, the ROM 113, the data transfer I/F 114, the head controller 115, the laser controller 116, the image processing accelerator 117, the motor controller 118, and the camera I/F 119.

The CPU 111 executes the later-described processing according to programs that are held in the ROM 113 or the RAM 112. The RAM 112 is a volatile storage, which temporarily holds programs and data. The ROM 113 is a non-volatile storage, which holds various kinds of table data and programs.

The data transfer I/F (interface) 114 controls transmission and reception of data to and from the host 100.

The head controller 115 controls a heating operation of the heater board 231 (see FIG. 2) mounted on the print head 230 (see FIG. 2), based on recording data, so that ink is ejected from nozzles of the print head 230. Specifically, the head controller 115 may be configured to read control parameters and recording data from a predetermined address of the RAM 102. Further, if the CPU 111 writes a control parameter and recording data to the predetermined address of the RAM 112, the head controller 115 activates the processing, so that the heating operation is performed by the heater board 231 mounted on the print head 230.

The laser controller 116 controls the laser sensor light-emitting unit 221 (see FIG. 2) to emit a laser. The laser sensor light-emitting unit 221 is a sensor used for adjusting the height of the finger rests 251 to 254 (see FIG. 2) on which the fingers of the person to be printed, whose nails are to be printed, are placed. Details will be described later.

The image processing accelerator 117 is configured with hardware and executes image processing at a higher speed than the CPU 111. Specifically, the image processing accelerator 117 may be configured to read parameters and data required for image processing from a predetermined address of the RAM 112. Further, if the CPU 111 writes the above-described parameters and data to the above-described predetermined address of the RAM 112, the image processing accelerator 117 is activated, and predetermined image processing is performed. Note that the image processing accelerator 117 may be configured in a given manner. Depending on the specifications of the nail printing apparatus 110, etc., the processing of creating the above-described table parameters and the image processing may be executed only with the processing performed by the CPU 111.

The motor controller 118 is a control unit that controls motor operations of multiple motor units which are not illustrated in the drawings. In the present embodiment, a motor unit is used to move the print head 230 two-dimensionally relative to a printing target nail. Further, the finger rests 251 to 254 are configured to be movable in the upward direction and the downward direction, and the motor units are also used as a mechanism for raising or lowering the finger rests 251 to 254. That is, the motor controller 118 can control the heights of the finger rests 251 to 254 by controlling the motor units. Note that the method for raising or lowering the finger rests may be performed by a method other than the method using the motor units. Depending on the type of printer, a motor for maintenance of the print head may be installed.

The camera I/F 119 is an I/F for connecting to the camera 240 to obtain image data which is acquired by image-capturing with the camera 240. It is also possible that the camera 240 is connected to the host 100 via the camera I/F 108. In that case, the image data of a captured image which is acquired by image-capturing with the camera 240 may be received from the host 100 via the data transfer I/F 114, for example. Note that the camera 240 may be included in the configuration of the nail printing apparatus 110.

For example, an inkjet printer or the like whose inkjet head for recording an image by injecting ink as droplets is a print head can be applied to the nail printing apparatus 110. Further, the nail printing apparatus of the present embodiment may be a multifunction peripheral having multiple functions such as a copy function, a fax function, and a print function.

Configuration of the Nail Printing Apparatus

Figure 2:
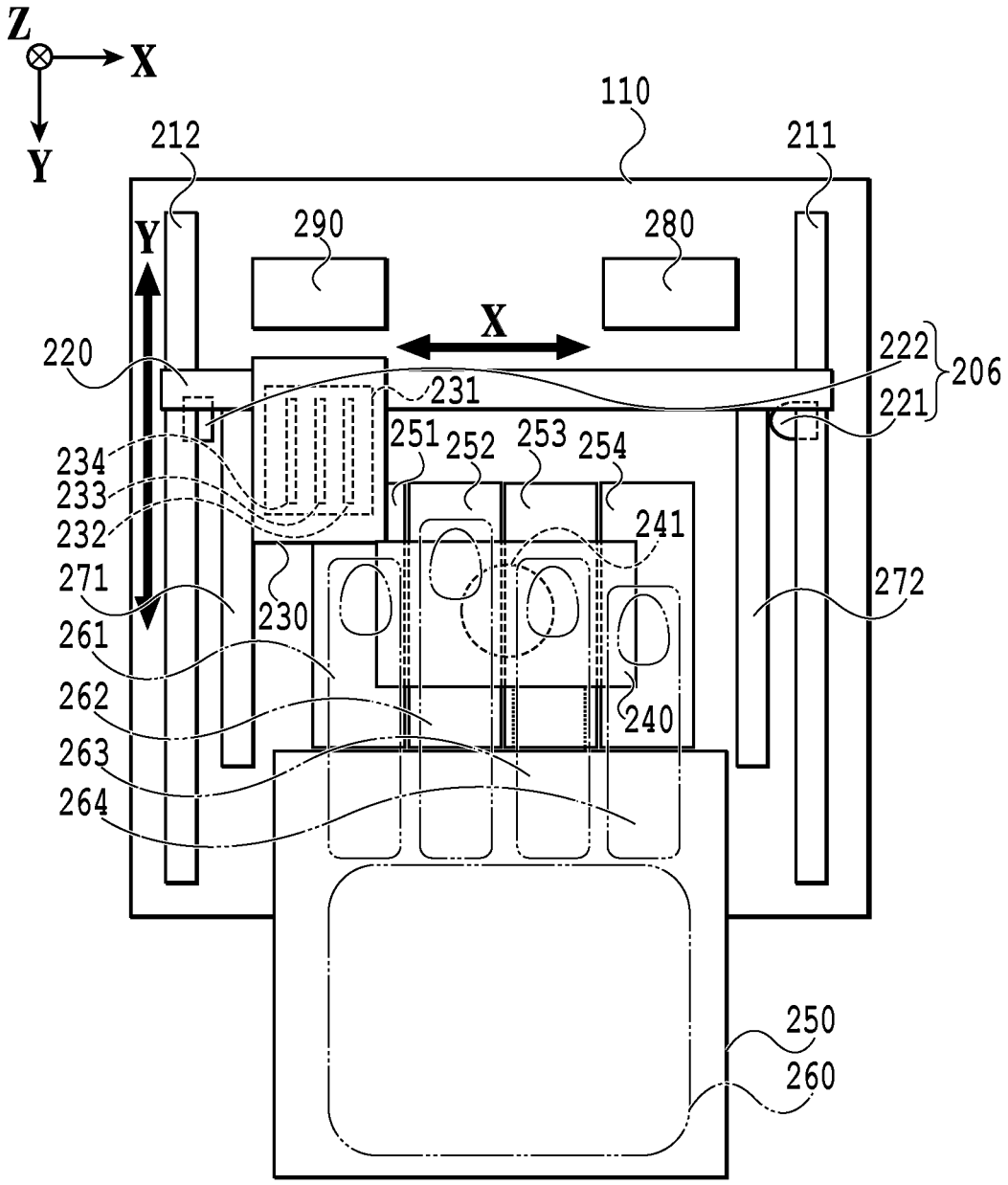
FIG. 2 is a top view illustrating a configuration of a nail printing apparatus.

FIG. 2 is a top view illustrating the configuration of the nail printing apparatus 110 of the present embodiment. FIG. 2 is a diagram schematically illustrating the upper surface of the nail printing apparatus 110 inside the housing. In the present specification, the direction along the X-axis is the left-right direction, the direction along the Y-axis is the front-rear direction, and the direction along the Z-axis which is perpendicular to the X-axis and the Y-axis is the up-down direction. Further, the +Y direction is the front side, the −Y direction is the rear side, the +Z direction is the downward direction, and the −Z direction is the upward direction.

The nail printing apparatus 110 has the Y-direction rail guides 211 and 212 for moving the print head 230 in the front-rear direction. Further, the nail printing apparatus 110 has the X-direction rail guide 220 for moving the print head 230 in the left-right direction, which intersects the front-rear direction.

The heater board 231 is mounted below the print head 230. The following nozzles for ejecting ink are arranged on the heater board 231.

Cyan ink ejection nozzle 232
Magenta ink ejection nozzle 233
Yellow ink ejection nozzle 234

The movement directions in which the print head 230 of the present embodiment can be moved include not only the left-right direction but also the front-rear direction. For example, in a case where the scanning direction is set to the left-right direction, ink is ejected from the ink ejection nozzles 232 to 234 of the respective colors while the print head 230 moves in the left-right direction, so that one scanning and recording operation is performed. Subsequently, by moving the print head 230 in the front-rear direction and then performing the next scanning and recording operation, an image can be printed on a nail. Therefore, it is possible for the nail printing apparatus 110 of the present embodiment to print the image on the printing target nail while the position of the printing target nail is fixed.

The laser sensor light-emitting unit 221 is installed at one end of the X-direction rail guide 220, and the laser sensor light-receiving unit 222 is installed at the other end of the X-direction rail guide 220. Therefore, the laser sensor light-emitting unit 221 and the laser sensor light-receiving unit 222 are configured to move in the front-rear direction in synchronization with the movement of the print head 230 in the front-rear direction. Further, the laser sensor light-emitting unit 221 and the laser sensor light-receiving unit 222 are installed at positions downwardly distant from the ink ejection nozzles 232 to 234. The laser sensor light-emitting unit 221 emits a laser toward the laser sensor light-receiving unit 222 in the X direction. The laser sensor light-emitting unit 221 and the laser sensor light-receiving unit 222 may be collectively referred to as the laser sensor 206.

On the inner side of the ceiling unit of the nail printing apparatus 110, the camera 240 for capturing an image of a finger is installed. The lens 241 is arranged on the lower side of the camera 240.

On the floor side of the nail printing apparatus 110, the hand rest 250 for placing a palm and the finger rests 251 to 254 for fixing the finger positions are arranged. The nail printing apparatus 110 is capable of performing the control of independently adjusting the each position (heights) of the finger rests 251 to 254 in the Z-axis direction. That is, each of the finger rests 251 to 254 is configured to be independently movable in the direction facing the print head 230 which performs printing on the nails.

In FIG. 2, the back 260 and the fingers 261 to 264 of a hand of the person to be printed are schematically illustrated. The fingers of the person to be printed are placed on the finger rests 251 to 254 so as to extend in the front-rear direction. In the example of FIG. 2, the hand of the person to be printed is the right hand. The back 260 of the right hand is placed on the hand rest 250. It is assumed that the index finger 261 of the right hand is placed on the finger rest 251, the middle finger 262 is placed on the finger rest 252, the ring finger 263 is placed on the finger rest 253, and the little finger 264 is placed on the finger rest 254, respectively.

In the area where the print head 230 can move, the preliminary ejection spot 271 is arranged on one side (left side) in the X direction, and the preliminary ejection spot 272 is arranged on the other side (right side), respectively. The preliminary ejection spots 271 and 272 arranged at both ends in the X direction are receivers for receiving the ink ejected from the ink ejection nozzles 232 to 234. The print head 230 can move to the places where the preliminary ejection spots 271 and 272 are arranged and eject ink from the ink ejection nozzles 232 to 234. By performing preliminary ejection to eject a small amount of ink from the ink ejection nozzles 232 to 234 to the preliminary ejection spots 271 and 272, solidification of ink in the ink ejection nozzles 232 to 234 can be suppressed.

The cap 290 is arranged at the standby position where the print head 230 that is not performing the printing operation stands by. The cap 290 can be mounted on the ink ejection nozzles 232 to 234 of the print head 230 at the standby position. By capping the ink ejection nozzles 232 to 234, it is possible to protect the ink ejection nozzles 232 to 234 and suppress solidification of ink in the ink ejection nozzles 232 to 234 during the time on standby. Further, the blade 280, which is a wiper member for wiping the ink adhering to the ink ejection nozzles 232 to 234 before the print head 230 moves to the standby place where the cap 290 is located, is arranged.

Figure 3:
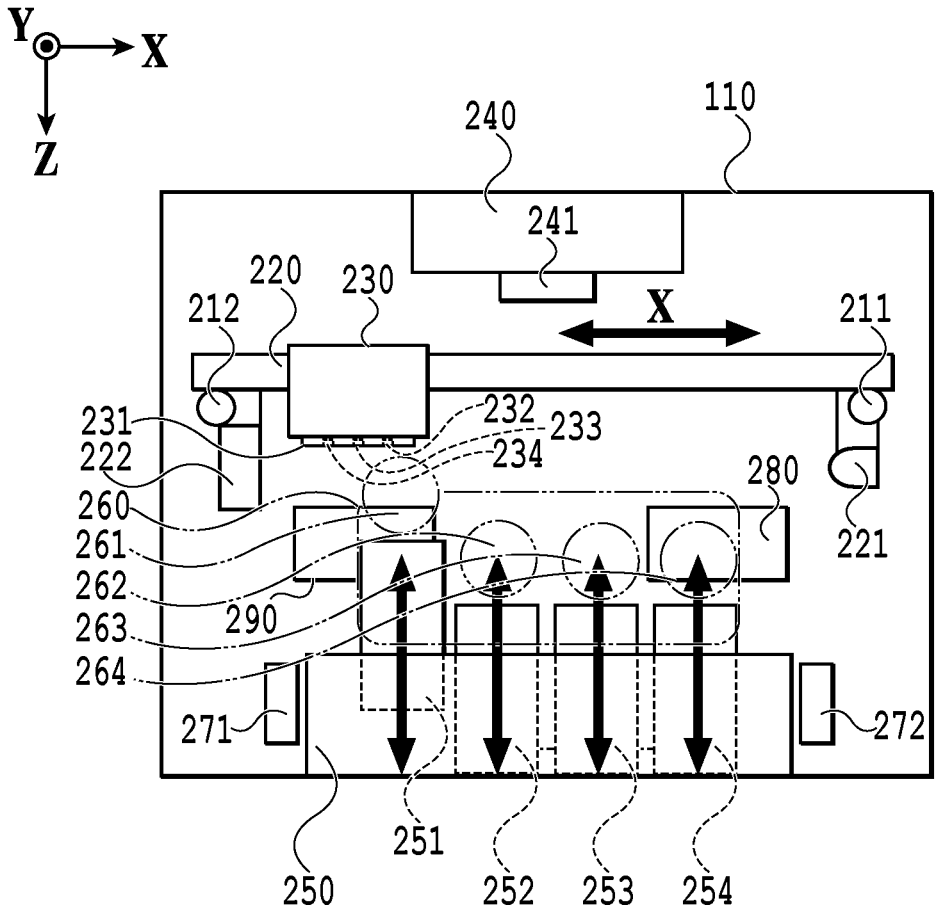
FIG. 3 is a front view illustrating the configuration of the nail printing apparatus.
Figure 4:
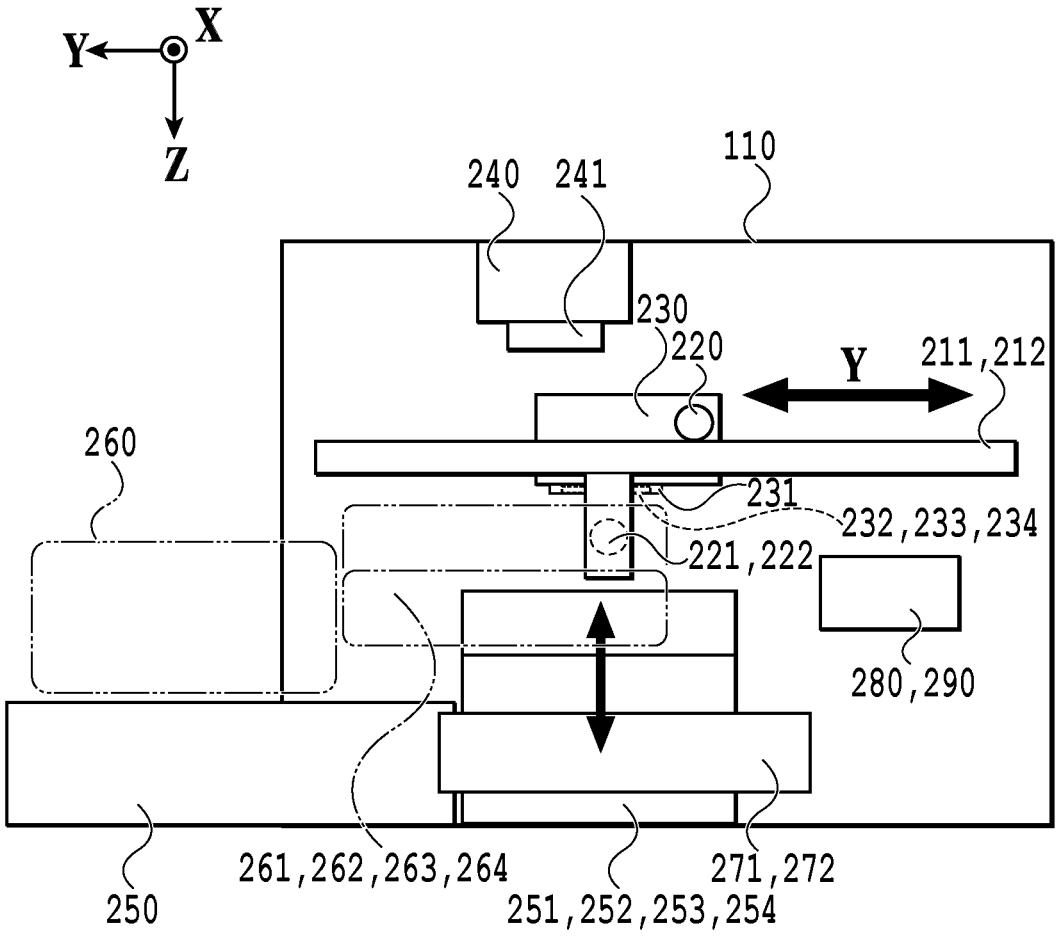
FIG. 4 is a side view illustrating the configuration of the nail printing apparatus.

FIG. 3 is a front view illustrating the configuration of the nail printing apparatus 110 of the present embodiment. FIG. 4 is a side view illustrating the configuration of the nail printing apparatus 110 of the present embodiment. As with FIG. 2, FIG. 3 and FIG. 4 are also diagrams schematically illustrating the nail printing apparatus 110 inside of the housing. The reference signs in FIG. 3 and FIG. 4 indicate the same configurations as in FIG. 2.

About Height Adjustment of the Finger Rests

Here, with reference to FIG. 2 to FIG. 4, the height adjustment of the finger rests 251 to 254 will be explained. By adjusting the heights of the finger rests 251 to 254, the positions of the nails in the Z direction relative to the respective ink ejection nozzles 232 to 234 of the print head 230 at the time of printing can be adjusted.

In order to print images of higher definitions on the nails, it is desired that the printing target nails are located at positions where the ink ejected from the respective ink ejection nozzles 232 to 234 can be properly landed. Therefore, by adjusting the heights of the finger rests 251 to 254, the relative distances between the nails and the ink ejection nozzles 232 to 234 in the Z direction are adjusted.

Each of the finger rests 251 to 254 is configured to be independently raised or lowered, and the motor controller 118 is capable of performing the control of adjusting the heights (positions in the Z-axis direction) of the finger rests 251 to 254 independently for each of the finger rests 251 to 254. In the present embodiment, one of the finger rests 251 to 254 is selected, and the height is adjusted for each finger rest that is selected. For example, in a case where the index finger 261, middle finger 262, ring finger 263, and little finger 264 of the right hand are placed on the finger rests 251 to 254, respectively, the heights will be adjusted in order from the finger rest 251, on which the index finger 261 is placed. If the height adjustment of the finger rest 251, on which the index finger 261 is placed, is completed, the finger rest 252 will be selected next and the height adjustment will be similarly performed. This order is an example of the order of the finger rests for height adjustment, and the height may be adjusted from any finger rest.

The movable laser sensor 206 (the laser sensor light-emitting unit 221 and the laser sensor light-receiving unit 222) mounted on the nail printing apparatus 110 is used for adjusting the height of each of the finger rests 251 to 254. In a case where the person to be printed places his or her fingers on the finger rests 251 to 254, the finger rests 251 to 254 are at the positions lowered to the initial positions. In this case, if the laser is emitted from the laser sensor light-emitting unit 221, the emitted laser is not blocked so that the laser sensor light-receiving unit 222 receives the laser. Therefore, at the start of the height adjustment, the laser emitted from the laser sensor light-emitting unit 221 is not blocked and received by the laser sensor light-receiving unit 222.

If the finger rests 251 to 254 continue to be raised, the laser being emitted from the laser sensor light-emitting unit 221 is blocked by a part of the fingers of the person to be printed placed on the finger rests 251 to 254. If it is determined that the laser is blocked and the laser sensor light-receiving unit 222 is not receiving the laser, the motor controller 118 performs the control of stopping raising the finger rests. By setting the position detected by the laser sensor 206 as the resting position for the raising of the finger rests as described above, the heights of the finger rests 251 to 254 can be adjusted.

The laser sensor light-emitting unit 221 and the laser sensor light-receiving unit 222 are located below the nozzles of the print head 230, and the position in the Z direction of the laser emitted from the laser sensor light-emitting unit 221 is a position where the ink can be properly landed by the print head 230. Therefore, if the raising of the finger rests 251 to 254 can be stopped in response to blocking of the laser with the nails of the fingers placed on the finger rests 251 to 254, the heights of the finger rests 251 to 254 can be adjusted so that the nails will be properly located at the landing position of ink. Therefore, it is preferable that the positions of the laser sensor light-emitting unit 221 and the laser sensor light-receiving unit 222 in the Y direction at the time of performing the height adjustment are the positions where the nail areas of the fingers placed on the finger rests, which are the targets of the height adjustment, are located.

Therefore, in the present embodiment, the nail areas are detected from the captured image of the fingers placed on the finger rests 251 to 254 before the height adjustment of the finger rests 251 to 254 is performed. By appropriately converting the coordinates (X coordinate, Y coordinate) of a nail area in the captured image to the coordinate position in the Y direction in the nail printing apparatus 110, it is possible to move the laser sensor 206 to a position corresponding to the nail area in the Y direction. Therefore, for example, in a case where the finger rest to be the target of the height adjustment is set to the finger rest 251, the laser sensor light-emitting unit 221 and the laser sensor light-receiving unit 222 can be moved in the Y direction to the positions where the nail of the finger placed on the finger rest 251 is located before the finger rest 251 is raised. Thereafter, if the finger rest 251 is raised, the laser is blocked by the nail of the finger placed on the finger rest 251. By raising the finger rest 251 until the laser is blocked, the height of the finger rest 251 can be adjusted so that the height of the nail of the finger placed on the finger rest 251 will be at a proper position. Note that the finger rests 252 to 254, which are not the target of the height adjustment, are controlled in a lowered state so that the laser is not blocked.

Processing Flow

Figures 5, 5A:
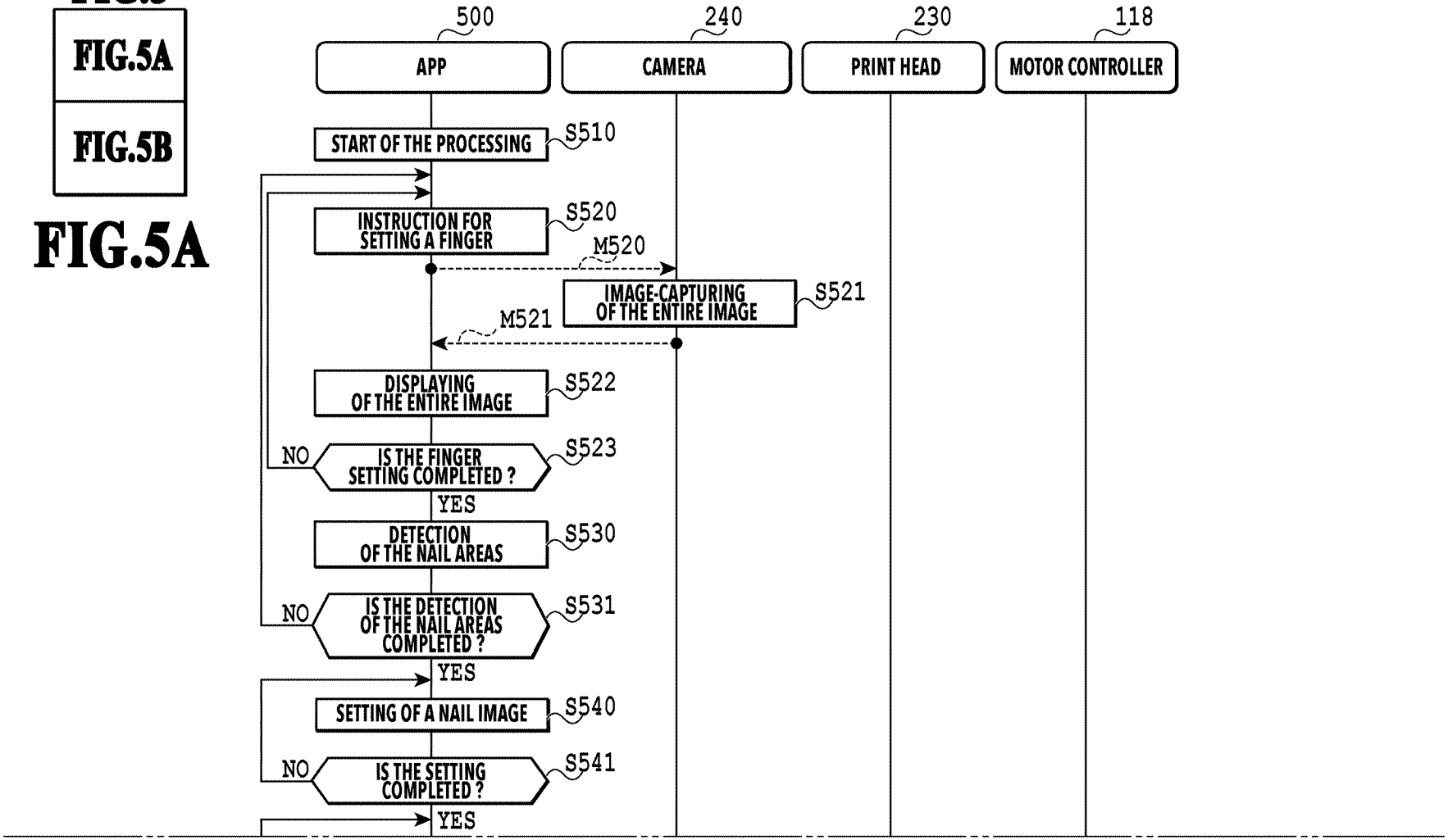
FIG. 5 is a diagram showing the relationship of FIG. 5A and FIG. 5B.
FIG. 5A is a diagram illustrating an example of a processing flow performed in the printing system.
Figure 5B:
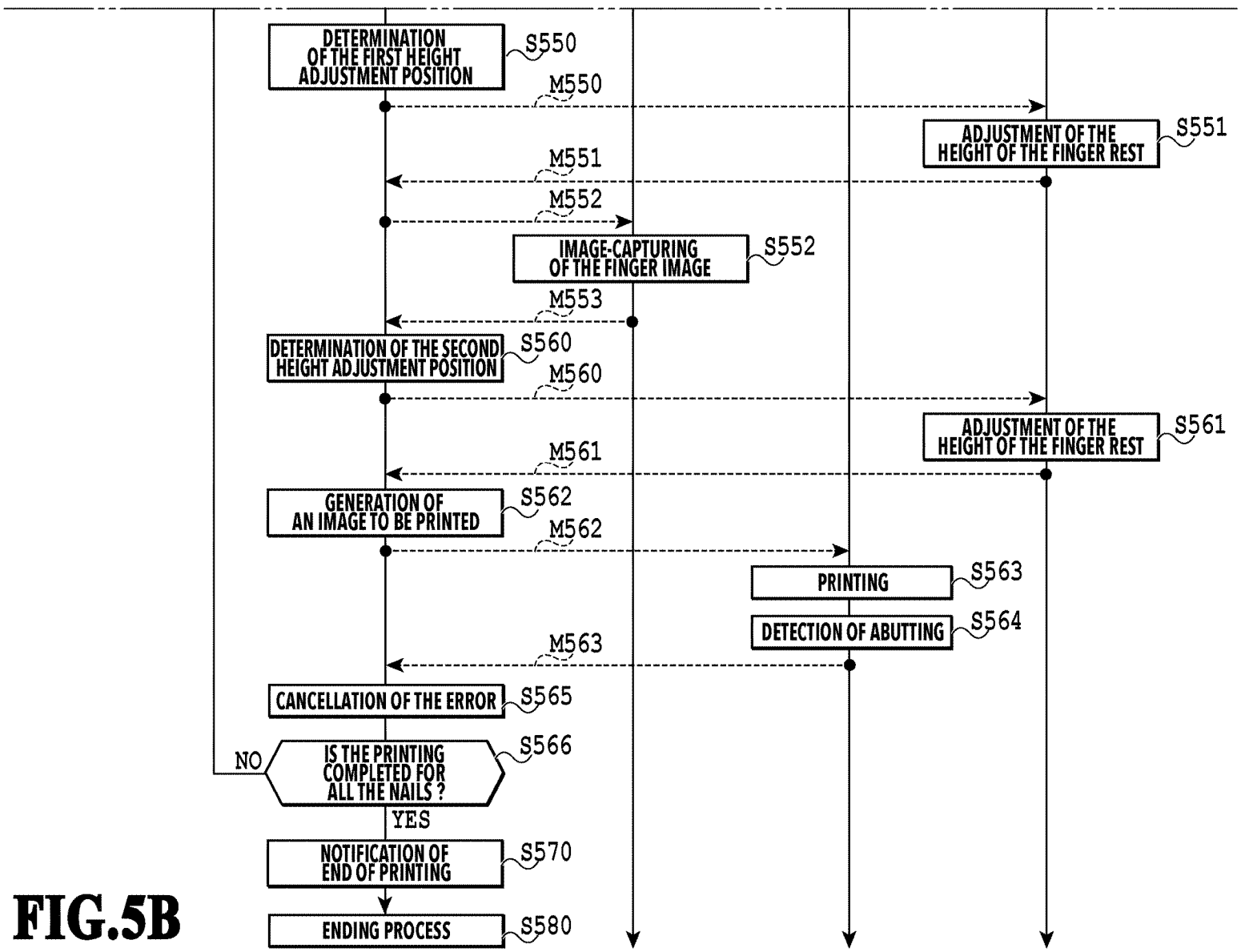
FIG. 5B is a diagram illustrating an example of a processing flow performed in the printing system.

FIG. 5 is a diagram illustrating an example of the processing flow for printing an image on the nails of the fingers placed on the finger rests 251 to 254, which is performed in the printing system of the present embodiment. The app 500 corresponds to processing executed by the host 100 of FIG. 1. That is, the app 500 corresponds to processing performed by a nail app activated by the host 100. The camera 240 captures an image of the fingers and transmits the image data of the captured image to the app 500. The nail printing apparatus 110 obtains an image to be printed, which is to be used for printing on nails, from the app 500, and the print head 230 is controlled by the motor controller 118, the head controller 115, etc., so that printing is performed on the actual nail portions of the fingers of the person to be printed. The motor controller 118 further controls the movement of the laser sensor 206 and controls the raising and lowering of the finger rests 251 to 254. Note that although the user (the person to be printed) on which an image is printed on the nails by the nail printing apparatus 110 and the user who operates the app are explained as the same person, it is also possible that they are different users.

The processing of the app 500 in FIG. 5 is performed by the CPU 101 of the host 100 loading a program code stored in the HDD 103 into the RAM 102 and executing the program code. Alternatively, a part or all of the functions in the steps of FIG. 5 may be implemented by hardware such as an ASIC or an electronic circuit. Note that the symbol "S" in the explanation of each process means that it is a step in the sequence.

In S510, the app 500 starts the processing. For example, the process of S510 is started in response to the user of the app 500 activating the nail app or the like. Further, if necessary, the processes of starting the camera 240, the head controller 115, and the motor controller 118 are also performed.

Next, the finger setting processes are performed in S520 to S523. First, in S520, the app 500 displays a screen for instructing the person to be printed to set his or her hand on the hand rest 250 and the finger rest 251 on the display device 107. The person to be printed places his or her fingers on the finger rests 251 to 254 as explained with reference to FIG. 2. Next, the app 500 outputs the entire image capturing message M520 to the camera 240. Note that, although the example in which four fingers are placed on the finger rests 251 to 254 is illustrated in FIG. 2 to FIG. 4, it is sufficient as long as at least one of the index finger, middle finger, ring finger, and little finger is placed. Further, in a case of performing printing on the thumb nail, only the thumb is placed.

In S521, the camera 240 captures an image of the entire fingers placed on the finger rests 251 to 254 and sends the entire captured image information message M521 to the app 500. The entire captured image information message M521 includes the image data of the entire image acquired by the image-capturing in the present step. For example, in a case where four fingers are placed on the finger rests 251 to 254, the camera 240 captures an image of the four fingers.

In S522, the app 500 obtains the entire image acquired by the image-capturing in S521 and displays the obtained entire image on the display device 107. Further, the app 500 also displays a "finger setting completion button", which is to be pressed by the person to be printed in a case where setting of the fingers is completed, on the display device 107.

In S523, the app 500 determines whether or not the "finger setting completion button" has been pressed. In a case where the person to be printed confirms the entire image and presses the "finger setting completion button", the processing proceeds to S530. If the "finger setting completion button" is not pressed, the processing returns to S520 so that the finger setting processes of S520 to S523 will be executed again.

Next, the nail area detection processes of S530 to S531 are performed. First, in S530, the app 500 analyzes the image data of the entire image of the fingers which is obtained as a result of the image-capturing in S521. Further, the number of nails included in the entire image and the information of each nail area indicating the X position, the Y position, the width in the X direction, the width in the Y direction, and the shape of the nail area are detected. The information of the positions and shapes obtained herein is the positions and shapes of the nail areas in the entire image (that is, a two-dimensional plane). The X direction is the direction along the longitudinal direction of the X-direction rail guide 220 in FIG. 2, and the Y direction is the direction along the longitudinal direction of the Y-direction rail guides 211 and 212 in FIG. 2.

The positions and shapes of the nail areas of the actual person to be printed are determined from the captured image since the positions and shapes of nails differ depending on the person to be printed. Further, the positions and shapes of the nail areas of the actual person to be printed are determined so as to print an image according to the actual positions and shapes of the nails.

As one method of detecting a nail area, there is a method of detecting the white color of the base coat applied to a nail by image processing. Specifically, pixels exceeding a predetermined threshold value (for example, R>200, G>200, B>200) are detected from the RGB values of the captured image, and the detected area is determined as a nail area. In order not to erroneously detect the finger rests 251 to 254 beneath the fingers as the nails in the nail detection, it is preferable that the color of the finger rests 251 to 254 is black or the like other than white. Further, it is desirable that the finger rests 251 to 254 are configured of a material that diffusely reflects light, so that a white area part in the captured image caused by the reflection of light is not erroneously detected as a nail area. Alternatively, it is also possible to perform edge detection processing on the captured image so that a nail area is detected by use of the information acquired as a result thereof. Alternatively, since the detection by image processing is difficult in a case where the base coat is translucent, it is also possible to use machine learning as another detection method. By using an image of a nail coated with a white or translucent base coat as an image to be a learning target in the machine learning, it is possible to detect a nail area even in a case of a translucent base coat, not only a white base coat. In the machine learning, a learning model is established by learning where in a prepared learning image a nail is located. The established learning model is incorporated in the app 500, processed by the CPU 101, and utilized to detect a nail area from a captured image. Since the color of the skin and the shape of a nail vary depending on the person, it is preferable that many hand patterns are prepared as the learning images for learning. There are many frameworks for machine learning, and machine learning can be implemented by utilizing existing frameworks.

In S531, the app 500 determines whether or not the nail areas are correctly detected. In a case where it is determined that the nail areas are correctly detected, the processing proceeds to S540, and, in a case where it is determined that the nail areas are not detected correctly, the processing returns to S520, so that the finger setting processes and the nail area detection processes will be repeated.

As the method for determining whether the nail areas are correctly detected, it is determined that the nail areas are correctly detected in a case where the following conditions are satisfied, for example. It will be determined that the positions and shapes of the nail areas have been detected correctly in a case where: the number of detected nail areas is 4; the nail areas exist at approximately equal intervals in the X coordinates; the nail of the middle finger is located on the rear side in the Y direction; and the nail of the little finger is located on the front side in the Y direction. On the other hand, it will be determined that the nail areas have not been detected correctly in a case where the number of obtained nail areas is 0 or more than 5, in a case where multiple nails are detected at almost the same X position, etc. In other cases, such as in a case where the number of obtained nail areas is 1 to 3, it is also possible to exclude undetected nails of fingers from the printing targets or register the positions and shapes of standard nail areas for the undetected nails of fingers, so as to proceed the processing to S540.

Next, the app 500 performs the nail image setting processes in S540 to S541. First, in S540, the app 500 displays information indicating that the nail image setting processes will be performed on the display device 107 for the person to be printed. Further, the app 500 also displays a "nail image setting completion button", which is to be pressed if the setting of nail images is completed.

As a result of this S540, the person to be printed at least selects "an image design to be printed on a nail". That is, the person to be printed selects a design to be printed on a nail through the display device I/F 106.

Figure 6B:
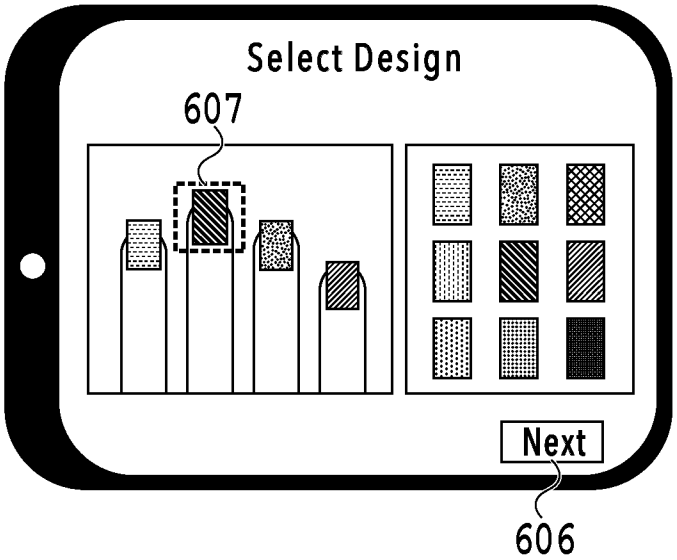
FIG. 6A and FIG. 6B are diagrams illustrating an example of a design selection screen displayed on a display device.
Figure 6A:
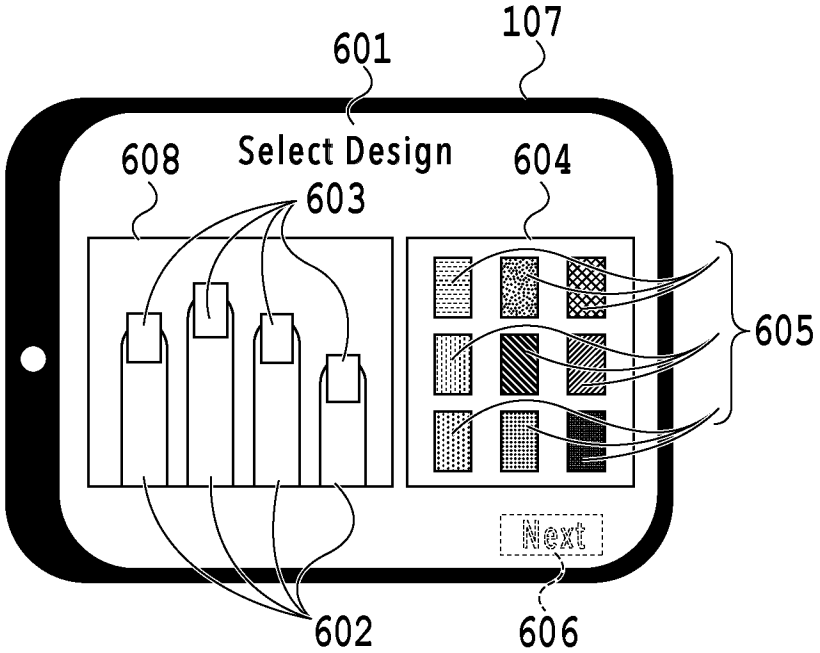

FIG. 6A and FIG. 6B are diagrams illustrating an example of the design selection screen 601 displayed on the display device 107. FIG. 6A is an example of a screen in a case where the designs have not been set, and FIG. 6B is an example of a screen in a case where the designs have been set. On the selection screen 601 of FIG. 6A, the finger models 602 and the nail models 603 are displayed. On the selection screen 601, the person to be printed selects which design is set for which nail of fingers. Note that, although the example in which the person who executes the design selection and the person to be printed are the same will be used in the present embodiment, it is also possible that they are different in a case of use in a nail salon or the like, for example.

The person to be printed selects a design to be used for printing on a nail from the design list 604 displayed on the selection screen 601. The design list 604 includes respective design images 605. Each design image 605 included in the design list 604 may be saved in advance in the HDD 103 in the host 100 or may be obtained from a network by use of the data transfer I/F 104. In a case where the person to be printed selects a design, a given one of the nail models 603 will be pressed first. The pressed nail model 603 will be in a selected state, and, as illustrated in FIG. 6B, the frame line 607 indicative of being selected will be displayed. By pressing each design image 605 included in the design list 604 in this state, the pressed design image 605 will be set for the nail model 603 that is in the selected state.

The nail image setting completion button 606 is a button for transitioning to the next step. The processing will be proceeded by pressing the nail image setting completion button 606 after selecting a design. Note that, in a case where no design image is selected, the nail image setting completion button 606 is grayed out and disabled as illustrated in FIG. 6A. The nail image setting completion button 606 will not be in such an abled state as illustrated in FIG. 6B until at least one design image is set.

In S541, the app 500 determines whether or not the person to be printed presses the nail image setting completion button 606. In a case where the determination result is No, the processing returns to S540 to continue the nail image setting processes, and, in a case where the determination result is Yes, the processing proceeds to S550. By repeating the series of processing flow of these S540 to S541 on a real time basis, the person to be printed can easily set an image for a nail area.

S550 to S552 are processes for selecting one finger rest and adjusting the height. The height adjustment processes of S550 to S552 are performed for each finger rest that is selected as the adjustment target from the finger rests 251 to 254, and the processes of S550 to S552 are repeated as many times as the number of finger rests on which the fingers are placed. In the following explanation, it is assumed that the finger rest of the adjustment target is the finger rest 251.

In S550, the app 500 determines the "first adjustment position" of the finger rest 251, which is the adjustment target, from the positions and shapes of the nail areas which are detected based on the entire image acquired by the image-capturing of S521. Further, the first height adjustment message M550, which includes the position information of the determined first adjustment position, is output to the nail printing apparatus 110. Although the explanation will be given on the premise that the "first adjustment position" is, for example, the position of the tip of a nail area on the rear side (fingertip side) in the Y direction of the finger placed on the finger rest 251 of the adjustment target, the first adjustment position is not limited to the tip of a nail area. Further, it is also possible to designate multiple positions of a nail area as the first adjustment positions.

In S551, the motor controller 118 first moves the laser sensor light-emitting unit 221 so that the position of the laser sensor light-emitting unit 221 in the Y direction will be at the position in the Y direction corresponding to the received first adjustment position. Then, the motor controller 118 performs the height adjustment of the finger rest 251 that is the adjustment target. The height adjustment in the present step is referred to as the first height adjustment. If the finger rest 251 of the adjustment target is raised by the motor controller 118 and it is determined that the state in which the laser sensor light-receiving unit 222 is receiving the laser has been changed to the state in which the laser sensor light-receiving unit 222 is not receiving the laser, the raising of the finger rest 251 of the adjustment target will be stopped. If the height adjustment is completed, the nail printing apparatus 110 outputs the first height adjustment completion message M551 to the app 500. Since there is a possibility that the fingers placed on the finger rests 252 to 254 block the laser, the finger rests 252 to 254 which are not the adjustment target will be kept in the lowered state.

Upon receiving the first height adjustment completion message M551, the app 500 outputs the finger image capturing message M552 to the camera 240 as an instruction for capturing an image of the nail of the finger placed on the finger rest 251 for which the first height adjustment has been performed.

In S552, the camera 240 captures an image of the nail of the finger placed on the finger rest 251, which is the adjustment target and is at the position for which the first height adjustment has been performed, and, after the image-capturing is completed, the finger image capturing information message M553 in which the captured image data is included is output to the app 500.

Next, the image printing processes on a nail are performed in S560 to S566. The image printing processes are performed for each nail of the fingers placed on the finger rests 251 to 254, and the image printing processes are repeated as many times as the number of nails on which a nail image will be printed. In the present embodiment, the explanation is given on the premise that the finger rest of the adjustment target, which is selected for the processes of S550 to S552, is directly selected as the printing target of S560 to S565. Alternatively, it is also possible that the processing proceeds to S560 after performing the processes of S550 to S552 for all the finger rests 251 to 254 and then the finger rest of the printing target is selected again in S560. In the following explanation, the case in which the finger rest 251 is selected as the finger rest of the printing target will be explained as an example.

In S560, the app 500 first detects the nail area, based on the captured image acquired as a result of the image-capturing in S552. That is, in the present step, the nail area of the finger of the printing target is detected based on the image acquired by capturing an image of the finger placed on the finger rest 251, which is located at a position for which the first height adjustment has been performed. The detection method is the same as S530.

Next, the app 500 determines the "second adjustment position" of the finger of the printing target, based on the detected nail area. Further, the second height adjustment message M560, which includes the position information of the determined second adjustment position, is output to the nail printing apparatus 110. The method for determining the "second adjustment position" is the same as the determination method for the "first adjustment position". For example, the "second adjustment position" is set to the position of the tip in the Y direction of the detected nail area.

In S561, the motor controller 118 moves the laser sensor light-emitting unit 221 to the second adjustment position. In a case where the position in the Y direction of the second adjustment position notified by the second height adjustment message M560 is the same as the position in the Y direction of the first adjustment position notified by the first height adjustment message M550, the laser sensor light-emitting unit 221 need not be moved in S561.

Next, the motor controller 118 performs the height adjustment of the finger rest 251 of the printing target. The height adjustment in the present step is referred to as the second height adjustment. If the finger rest 251 of the printing target is raised by the motor controller 118 and it is determined that the state in which the laser sensor light-receiving unit 222 is receiving the laser has been changed to the state in which the laser sensor light-receiving unit 222 is not receiving the laser, the raising of the finger rest 251 of the printing target will be stopped.

The nail of the finger placed on the finger rest 251 for which the first height adjustment has been performed is placed at a position closer to the camera 240 as compared to the position of the nail at the time of the image-capturing of S521. The nail detection accuracy is higher if the nail detection is performed based on a captured image acquired by capturing an image of a nail at a position closer to the camera 240. Therefore, the nail area detected in S560 has higher accuracy than the nail area detected in S530. Therefore, it is possible to perform the height adjustment of the finger rest 251 with higher accuracy before printing, based on the second adjustment position which is determined based on the highly accurate nail area.

Since there is a possibility that the fingers placed on the finger rests 252 to 254 block the laser, the finger rests 252 to 254 which are not the printing target will be kept in the lowered state. If the second height adjustment is completed, the second height adjustment completion message M561 is output to the app 500.

In S562, the app 500 generates an image to be printed on a nail. In the present embodiment, the app 500 determines the image area, based on the nail area of the captured image of the finger placed on the finger rest 251 for which the first height adjustment has been performed. Further, the image to be printed is generated by setting a nail image in the image area. The position of the nail of the finger placed on the finger rest 251 after the first height adjustment is a position close to the height after the second height adjustment, which is the height at which printing is actually performed. Therefore, in the present embodiment, since the image to be printed can be generated from a captured image that is acquired by capturing an image of a nail that is placed at a position close to the height at which printing is actually performed, it is possible to generate the image to be printed with which printing with higher accuracy can be performed.

Then, the app 500 displays information indicating "printing will be started" on the display device 107 and outputs the print message M562 including the image data of the generated image to be printed to the nail printing apparatus 110.

In S563, the print head 230 is controlled so as to perform printing on the nail of the finger that is the printing target by using the received image data of the image to be printed as the recording data. In a case where printing is completed, the nail printing apparatus 110 sends the message including print completion information to the app 500.

In the present sequence diagram, the processing in a case where an error occurs during the printing operation of S563 will be explained. Specifically, the explanation will be given on the premise that the error has occurred since the print head 230 abutted on an object such as a finger of the person to be printed. In a case where the print head 230 abuts on an object such as a finger of the person to be printed while the printing operation is in progress, it is detected in S563 that an object has abutted on the print head 230. Then, the printing operation is emergently stopped, and the print head 230 stops moving. Then, the nail printing apparatus 110 sends the error message M563, which indicates that the nail printing apparatus 110 is not in a normal state, to the app 500 since the print head 230 has abutted on an object. Details of the processing performed by the nail printing apparatus 110 in S561 to S564 will be described later.

In S565, the app 500 performs the process for canceling the error state. As a method of canceling the error, for example, the person to be printed is notified of the method of clearing the error, and, in a case where it is confirmed that the error has been cleared by the nail printing apparatus 110, the error will be cancelled. Note that, in a case where no error occurs in the printing operation of S563, the processes of S564 and S565 will be skipped.

In S566, the app 500 determines whether printing is completed for the number of detected nails. In a case where the printing is completed for all nails, the processing proceeds to S570. In a case where printing is not completed for all nails, the finger rest that is the adjustment target is selected, and the processes of S550 to S565 will be repeated until printing is completed for all nails.

In S570, the app 500 displays information indicating "printing is completed" on the display device 107. Finally, in S580, the app 500 performs an ending process to end the processing. If necessary, the processes of ending the camera 240, the head controller 115, and the motor controller 118 are also performed. The above is the explanation of a series of processes performed by the app 500 and the nail printing apparatus 110.

Note that, although it is assumed that the height adjustment is performed twice in the explanation of the present sequence diagram, it is also possible that the height adjustment is performed only once. In a case where the height adjustment is performed only once, S551, S552, and S560 will be skipped, and the transmission and reception of the messages M551 to M553 and M560 will also be skipped. In this case, the height adjustment is performed based on the first adjustment position in S561, and the image to be printed is generated in S562, based on the entire image acquired by the image-capturing in S521.

Height Adjustment and Print Processing of the Nail Printing Apparatus

Figure 7:
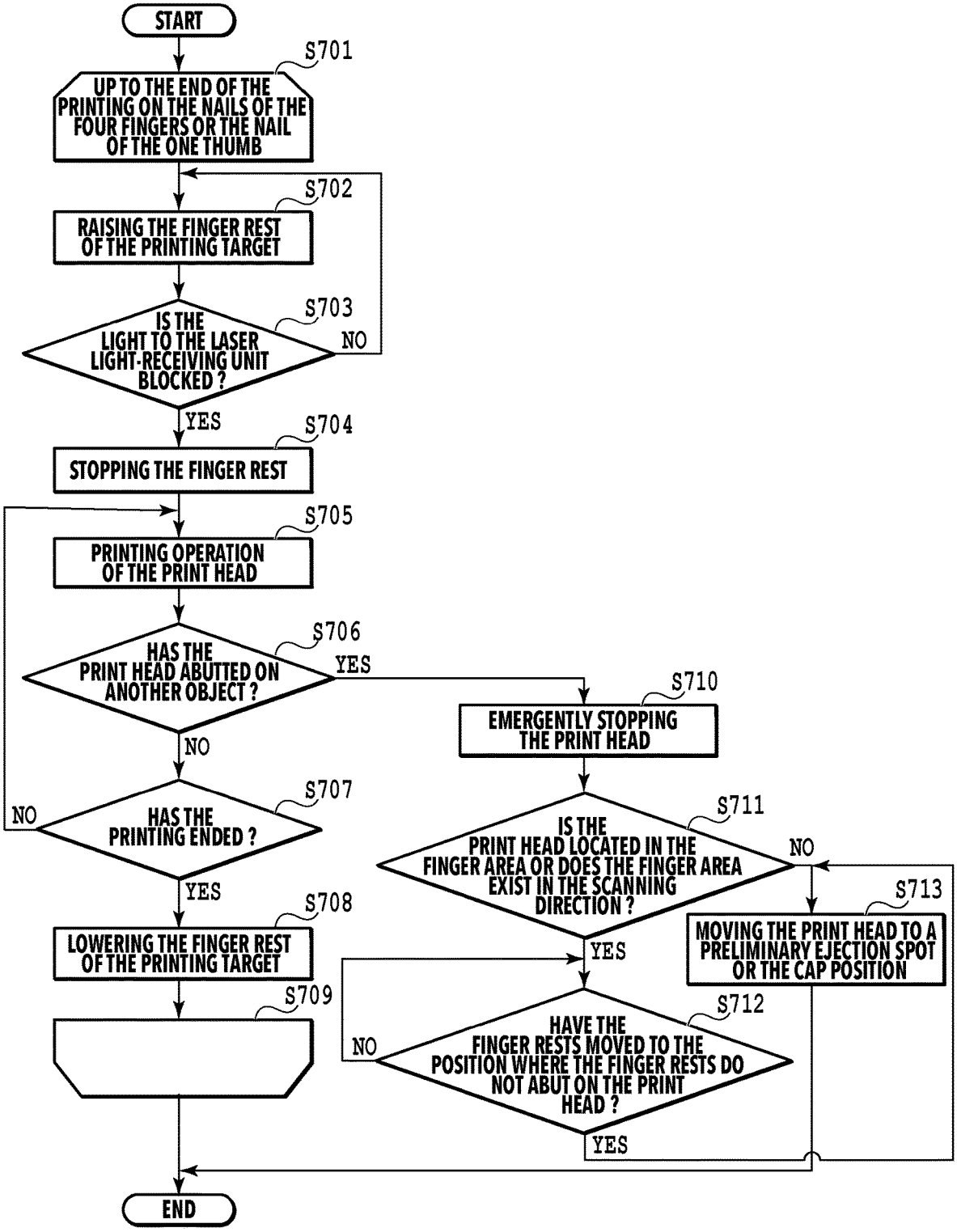
FIG. 7 is a flowchart for explaining height adjustment of finger rests and print processing of a nail image.

FIG. 7 is a flowchart for explaining the details of the height adjustment processing and the print processing for the finger rests 251 to 254 executed in the nail printing apparatus 110. If the process of S561 of FIG. 5 is started, the processing of the flowchart of FIG. 7 will be started.

The series of processes illustrated in the flowchart of FIG. 7 is performed by the CPU 111 of the nail printing apparatus 110 loading a program code stored in the ROM 113 into the RAM 112 and executing the program code. It is also possible that a part or all of the functions in the steps of FIG. 7 are implemented by hardware such as an ASIC or an electronic circuit. Note that, as described above, the raising and lowering of the finger rests 251 to 254 and the movement of the laser sensor 206 are performed via the motor controller 118. The movement of the print head 230 for performing the printing operation is performed via the motor controller 118, and the ejection of ink from the ink ejection nozzles 232 to 234 is performed via the head controller 115. Note that the symbol "S" in the explanation of each process means that it is a step in the flowchart.

S701 to S709 are loop processing, and S701 to S709 are repeated for the number of printing target nails. That is, a printing target nail is selected from the unprinted nails, and the processes of S701 to 709 are performed on the selected nail. If the print processing on the printing target nail is completed, a printing target nail will be selected from the unprinted nails. If there are no unprinted nails, the loop processing ends.

In a case where the index finger, middle finger, ring finger, and little finger are placed on the finger rests 251 to 254, the processes of S701 to S709 will be repeated until printing on the nails of the four fingers placed on the finger rests 251 to 254 is completed. In a case where a thumb is placed on the finger rest 251 or the finger rest 254 for printing on the nail of the thumb, the processes of S701 to S709 will be performed only for the nail of the thumb. The app 500 determines the printing target nails and notifies the nail printing apparatus 110 of the printing target nails together with the adjustment positions of the printing target nails.

Hereinafter, in the explanation of the present flowchart, the case in which the index finger, middle finger, ring finger, and little finger are placed on the finger rests 251 to 254 and the nail of the index finger placed on the finger rest 251 is selected in S701 as the printing target nail will be explained.

In S702, the finger rest 251 starts rising. Here, the laser is emitted from the laser sensor light-emitting unit 221 that has been moved to the adjustment position. The explanation will be given on the premise that the laser sensor light-receiving unit 222 receives the laser emitted from the laser sensor light-emitting unit 221 at the time where the finger rest 251 starts rising.

In S703, the CPU 111 determines whether the laser sensor light-receiving unit 222 no longer receives the laser. If the determination result is NO, the processing returns to S702, so that the process of raising the finger rest 251 is continued. In a case where the laser emitted from the laser sensor light-emitting unit 221 toward the laser sensor light-receiving unit 222 is blocked by the nail of the index finger 261 which is placed on the rising finger rest 251, the laser sensor light-receiving unit 222 no longer receives the laser. Here, it is determined that the laser sensor light-receiving unit 222 no longer receives the laser, and it is determined as YES. If the determination result is YES, the processing proceeds to S704.

In S704, the finger rest 251 stops rising. By stopping the rising of the finger rest 251 in response to the laser being blocked by the nail of the index finger 261 placed on the finger rest 251, the height of the finger rest 251 is adjusted so that the distance from the print head 230 to the printing target nail of the index finger 261 becomes an appropriate distance.

The printing operation is performed in S705, and the print head 230 performs the operation for printing a nail image on the printing target nail of the finger placed on the finger rest 251.

In S706, the CPU 111 determines whether the print head 230, with which the printing operation is in progress, has abutted against an object such as a finger of the person to be printed. If it is not determined that the print head 230 has abutted against an object (NO in S706), the processing proceeds to S707.

In S707, the CPU 111 determines whether the printing of the nail image on the printing target nail has ended. In a case where the determination result is NO, the processing returns to S705 to continue the printing operation, and, in a case where the determination result is YES, the processing proceeds to S708. In S708, the finger rest 251 is lowered to the initial position.

In S709, the CPU 111 determines whether the printing of the image is completed for the nails of all the fingers placed on the finger rests 251 to 254. If there are unprinted nails, the processing returns to S701, so that a notification of a printing target nail out of the unprinted nails is provided by the app 500, and S701 to 708 will be repeated. The present flowchart ends if the printing is completed for all nails. Alternatively, in a case where only the thumb is placed on the finger rests 251 to 254, the present flowchart ends if the printing on the nail of the thumb has ended.

On the other hand, in a case where it is determined in S706 that the print head 230 has abutted on an object while the printing operation is in progress (YES in S706), the processing exits the loop processing of S701 to S709 and proceeds to S710. In principle, the print head 230 does not abut on an object such as a finger of the person to be printed in the printing operation. However, for example, if the person to be printed raises the finger of the nail being printed higher than the position where the finger rest 251 is stopped in S704, there is a possibility that the print head 230 abuts on the finger of the person to be printed.

As the method of determining whether the print head 230 has abutted on an object such as a finger during the printing operation, for example, in a case where the print head 230 cannot physically operate while the printing operation is in progress, it is determined that the print head 230 has abutted on an object. For example, in a case where the print head 230 with which the printing operation is in progress stops at a position where the print head 230 is not supposed to stop, it is determined that the print head 230 has abutted on an object.

In S710, the CPU 111 performs the control of emergently stopping the printing operation. If the emergency stop is performed, the movement of the print head 230 is stopped, and the ink ejection nozzles 232 to 234 are also controlled to stop ejecting ink. Stopping the driving of the print head 230 while the print operation is in progress regardless of the control of the print head associated with the print operation is referred to as the emergency stop.

Note that the previous step S706 is a step for determining whether an error that causes the emergency stop to be executed has occurred. As explained in S706, in the explanation of the present flowchart, it is assumed that the abutting of the print head 230 on an object during the printing operation is an error that causes the emergency stop to be executed. In addition, for example, it is also possible that a case where a cover of the nail printing apparatus 110, which is not illustrated in the drawings, is opened while the printing operation is in progress is considered as an error that causes the emergency stop to be executed.

In S711, the CPU 111 determines whether the current position of the print head 230 is a position inside the finger area or whether the current position of the print head 230 is a position where the finger area exists in the scanning direction. The scanning direction is the direction in which the print head 230 was moving for the scanning and recording operations immediately before the emergency stop. The current position of the print head 230 during the process of the present step is the stop position where the movement of the print head 230 was stopped due to the emergency stop.

Figure 8:
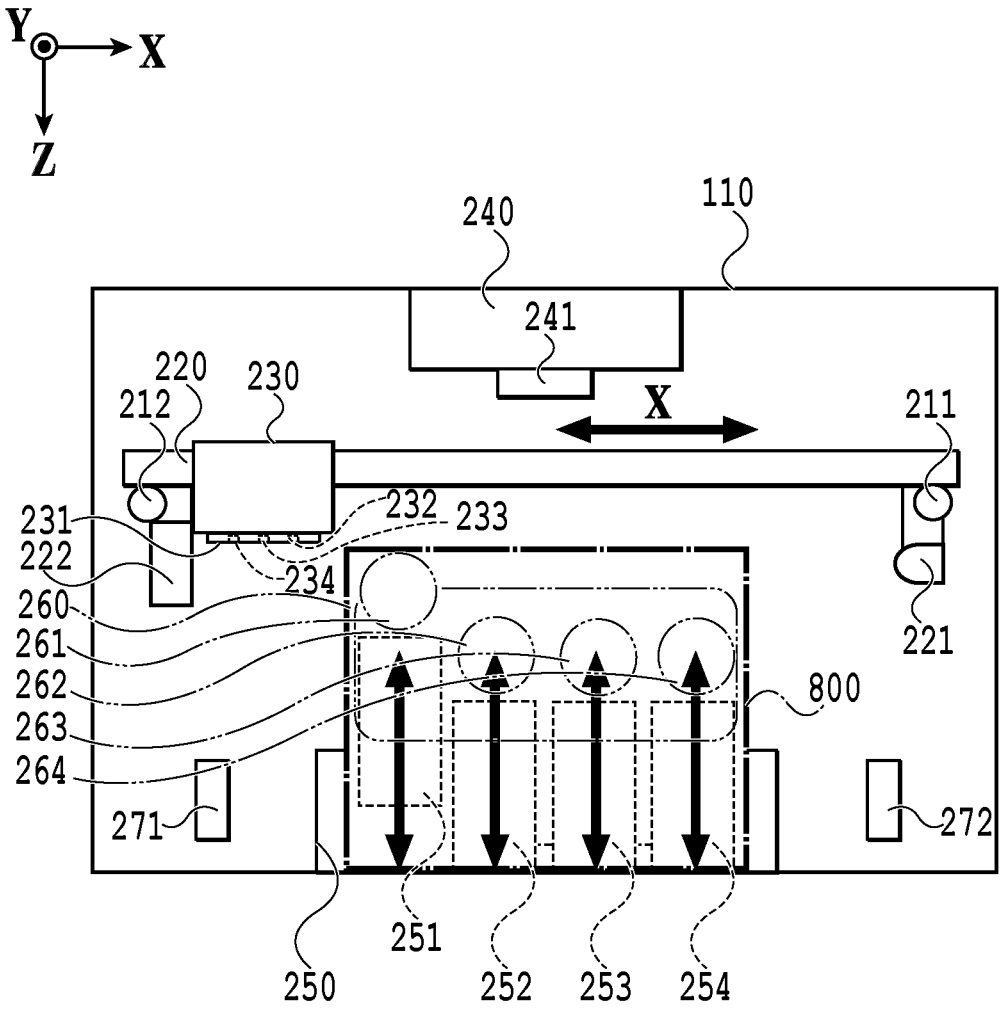
FIG. 8 is a diagram for explaining nail areas.
Figure 9:
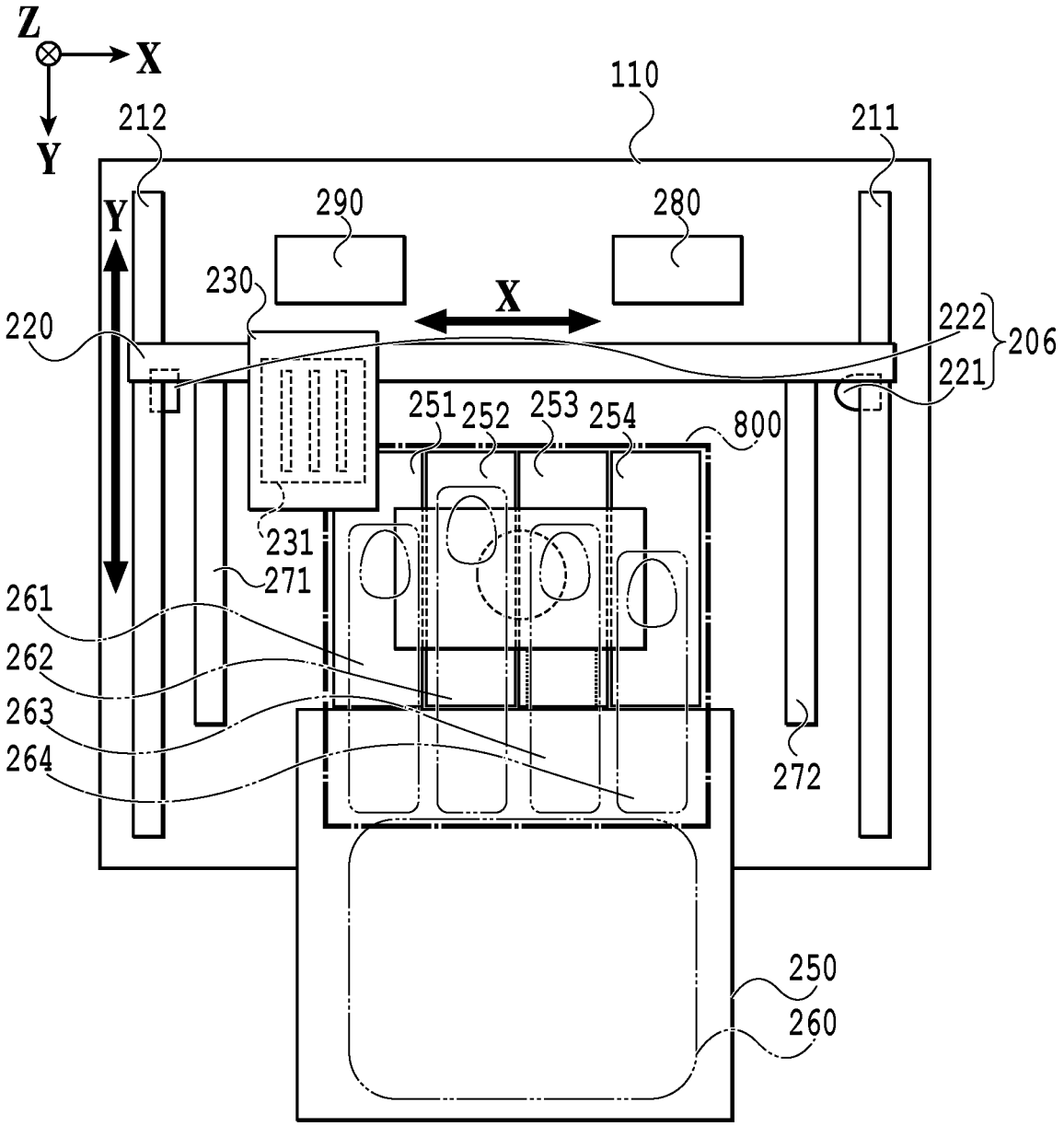
FIG. 9 is a diagram for explaining the nail areas.

FIG. 8 is a front view of the nail printing apparatus 110 for explaining a finger area. FIG. 9 is a top view of the nail printing apparatus 110 for explaining the finger area. The finger area 800 illustrated as the frame of the long dashed short dashed line in FIG. 8 and FIG. 9 is an area that at least includes an area where the fingers of the person to be printed are actually located and is an area representing a range in which the print head 230 has a chance of abutting on a part of the hand of the person to be printed. In a case where it is determined that the print head 230 is located in the finger area 800, the print head 230 is controlled so as not to move after an emergency stop in consideration of safety. The finger area may be an area that is determined in advance based on the positions of the finger rests 251 to 254 as illustrated in FIG. 8 or may be determined as an area corresponding to the hand of the person to be printed, based on the result of the finger area detection in S530 of FIG. 5.

For example, in a case where the position of the print head 230 illustrated in FIG. 9 is the stop position of an emergency stop, the position of the stop position on the XY plane is included in the area on the XY plane of the finger area 800. In this case, it is determined in S711 that the print head 230 is located in the finger area 800 (it is determined as YES in S711). Alternatively, in a case where the position of the print head 230 illustrated in FIG. 8 is the stop position of an emergency stop and the scanning direction of the print head 230 in the printing operation immediately before the emergency stop is the direction from the left to the right of FIG. 8, the finger area 800 exists in the scanning direction. Therefore, it is determined that the finger area exists in the scanning direction (it is determined as YES in S711).

In a case where it is determined as YES in S711, the print head 230 is controlled to be stopped for safety. For example, in a case of performing a notification to the person to be printed, the notification includes the emergency stop that was executed because of the print head 230 being abutted on an object while the print head 230 is in the stopped state.

Then, in S712, the CPU 111 determines whether the finger of the person to be printed has been moved to a safe place. For example, in S712, the CPU 111 determines whether all the finger rests 251 to 254 have been lowered to the initial position, which is in the direction opposite to the direction in which the print head 230 is located. Note that, in a case where it is determined as YES in S711, the finger rests 251 to 254 starts the lowering operation. Then, after the start of the lowering of the finger rests 251 to 254, the determination step in S712 is performed.

In a case where it is determined as YES in S712, the processing proceeds to S713. Further, in S711, in a case where the stop position of the print head 230 at the time of the emergency stop is a position other than the position inside the finger area and the finger area does not exist in the scanning direction (NO in S711), the CPU 111 proceeds the processing to S713.

In S713, the print head 230 is controlled to move to the standby position where the preliminary ejection spot 271 or 272 or the cap 290 is arranged. At the preliminary ejection spots 271 and 272, the print head 230 can perform preliminary ejection from the ink ejection nozzles 232 to 234. Further, at the standby place, the cap 290 is mounted on the ink ejection nozzles 232 to 234 of the print head 230. Therefore, even if the print head 230 moves to any of the preliminary ejection spots 271, 272, and the standby place, it is possible to suppress the drying of the ink ejection nozzles 232 to 234 or the solidification of adhering ink.

For example, if the stop position of the print head 230 at the time of the emergency stop is a position to the left of the finger area 800 of FIG. 8 and the scanning direction of the print head 230 immediately before the emergency stop is from the right to the left, the print head 230 is located outside the finger area and the finger area does not exist in the scanning direction. Therefore, it is determined as NO in S711, and, in S713, the print head 230 moves to the standby place where the preliminary ejection spot 271 or the cap 290 is located.

Alternatively, if the stop position of the print head 230 at the time of the emergency stop is a position to the right of the finger area 800 and the scanning direction of the print head 230 immediately before the emergency stop is from the left to the right, the print head 230 is located outside the finger area and the finger area does not exist in the scanning direction. Therefore, it is determined as NO in S711, and, in S713, the print head 230 moves to the standby place where the preliminary ejection spot 272 or the cap 290 is located.

After the emergency stop, the print head 230 moves to the preliminary ejection spot 271, 272, or the cap 290, and then the processing of the present flowchart ends. If the error cancellation process performed after the emergency stop ends, the printing operation will be restarted, and thus, in principle, the print head 230 is controlled to move to the preliminary ejection spot 271 or 272 in S713. In a case where the printing operation will not be restarted, the print head 230 is controlled to move to the standby place where the cap 290 is located.

Thereafter, the app 500 performs the error cancellation process in S565 of FIG. 5. As a method of canceling an error, for example, the app 500 notifies the person to be printed of a method of clearing the error associated with the emergency stop via the display device 107. Then, in a case where it is confirmed that the error has been cleared in the nail printing apparatus 110, the nail printing apparatus 110 outputs a message to that effect to the app 500. The app 500 cancels the error in S565 upon receiving the message.

As explained above, in the present embodiment, the movement of the print head after an emergency stop is controlled based on the stop position of the print head at the time of the emergency stop. Therefore, according to the present embodiment, after an emergency stop, it is possible to perform the processing for reducing the drying of ink adhering to the ink ejection nozzles 232 to 234 of the print head while considering the safety of the person to be printed. Therefore, even in a case where the driving of the print head is stopped while the printing operation is in progress, it is possible to reduce the occurrence of printing defects caused by improper ejection of ink due to the drying.

According to the technique of the present disclosure, it is possible to reduce the occurrence of troubles during printing even in a case where the driving of the print head is stopped while the printing operation is in progress.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-053239 filed Mar. 26, 2021, which is hereby incorporated by reference herein in its entirety.

What is claimed is:

1. A nail printing apparatus comprising:

a print head configured to perform a printing operation in which an image on a nail of a person to be printed is printed by moving in a scanning direction and ejecting ink from a nozzle; and a control unit configured to control movement of the print head, wherein, in a case where movement of the print head is stopped regardless of controlling of movement of the print head associated with the printing operation, the control unit switches the controlling of movement of the print head after the stopping based on a stop position of the print head, wherein in a case where the stop position is a position other than a predetermined position, the control unit moves the print head to a predetermined place for suppressing drying of the nozzle, in a case where the stop position is the predetermined position, the control unit does not move the print head from the stop position after the stopping until a predetermined condition is satisfied, and a case where the predetermined condition is satisfied is a case where a finger of the person to be printed is moved in a direction opposite to a direction in which the print head is located at the time where the printing is performed on the nail.

2. The nail printing apparatus according to claim 1, further comprising a cap configured to be mounted on the nozzle, wherein the predetermined place is a place where the cap is arranged.

3. The nail printing apparatus according to claim 1, further comprising at least one receiver configured to receive ink which is preliminarily ejected from the nozzle, wherein the predetermined place is a place where the at least one receiver is arranged.

4. The nail printing apparatus according to claim 3, wherein the at least one receiver comprises a plurality of receivers arranged at both ends in the scanning direction.

5. The nail printing apparatus according to claim 1, wherein the predetermined position is a position inside an area including a finger of the person to be printed in the nail printing apparatus.

6. The nail printing apparatus according to claim 1, wherein the predetermined position is a position where an area including a finger of the person to be printed in the nail printing apparatus exists in the scanning direction in which the print head was moving before the stopping.

7. The nail printing apparatus according to claim 5, further comprising a finger rest on which a finger of the person to be printed is placed, wherein the print head prints the image on the nail of the finger placed on the finger rest.

8. The nail printing apparatus according to claim 7, wherein the area is an area where the finger rest is located.

9. The nail printing apparatus according to claim 7, further comprising an image-capturing unit configured to capture an image of the finger placed on the finger rest, wherein the area is an area determined based on the captured image obtained by the image-capturing unit.

10. The nail printing apparatus according to claim 7, wherein the finger rest on which the finger whose nail is to be printed by the print head is placed moves to a resting position before the printing, the resting position being a position in a direction facing the print head at the time where the printing is performed on the nail.

11. The nail printing apparatus according to claim 10, further comprising a sensor configured to detect the resting position.

12. The nail printing apparatus according to claim 1, wherein the print head is an inkjet head.

13. A control method of a nail printing apparatus comprising a print head configured to perform a printing operation in which an image on a nail of a person to be printed is printed by moving in a scanning direction and ejecting ink from a nozzle, the control method comprising, in a case where movement of the print head is stopped regardless of controlling of movement of the print head associated with the printing operation, switching the controlling of movement of the print head after the stopping based on a stop position of the print head, in a case where the stop position is a position other than a predetermined position, moving the print head to a predetermined place for suppressing drying of the nozzle, in a case where the stop position is the predetermined position, moving the print head from the stop position after the stopping until a predetermined condition is satisfied, and a case where the predetermined condition is satisfied is a case where a finger of the person to be printed is moved in a direction opposite to a direction in which the print head is located at the time where the printing is performed on the nail.

14. A nail printing apparatus comprising:

a print head configured to perform a printing operation in which an image on a nail of a person to be printed is printed by moving in a scanning direction and ejecting ink from a nozzle; and a control unit configured to control movement of the print head, wherein, in a case where movement of the print head is stopped regardless of controlling of movement of the print head associated with the printing operation, the control unit switches the controlling of movement of the print head after the stopping based on a stop position of the print head, wherein in a case where the stop position is a position other than a predetermined position, the control unit moves the print head to a predetermined place for suppressing drying of the nozzle, and the predetermined position is a position inside an area including a finger of the person to be printed in the nail printing apparatus.

15. The nail printing apparatus according to claim 14, further comprising a finger rest on which a finger of the person to be printed is placed, wherein the print head prints the image on the nail of the finger placed on the finger rest.

16. The nail printing apparatus according to claim 15, wherein the area is an area where the finger rest is located.

17. The nail printing apparatus according to claim 15, further comprising an image-capturing unit configured to capture an image of the finger placed on the finger rest, wherein the area is an area determined based on the captured image obtained by the image-capturing unit.

18. The nail printing apparatus according to claim 15, wherein the finger rest on which the finger whose nail is to be printed by the print head is placed moves to a resting position before the printing, the resting position being a position in a direction facing the print head at the time where the printing is performed on the nail.

19. The nail printing apparatus according to claim 18, further comprising a sensor configured to detect the resting position.

20. The nail printing apparatus according to claim 14, wherein the print head is an inkjet head.

* * * * *